United States Patent [19]

Finkelstein

[11] 4,199,945

[45] Apr. 29, 1980

[54] METHOD AND DEVICE FOR BALANCED COMPOUNDING OF STIRLING CYCLE MACHINES

[76] Inventor: Theodor Finkelstein, P.O. Box 643, Beverly Hills, Calif. 90213

[21] Appl. No.: 819,583

[22] Filed: Jul. 27, 1977

[51] Int. Cl.[2] ..... F02G 1/04

[52] U.S. Cl. ..... 60/520; 60/525

[58] Field of Search ..... 60/517, 525, 526, 520

[56] References Cited

U.S. PATENT DOCUMENTS

| | | | |
|---|---|---|---|
| 2,564,363 | 8/1951 | Horowitz | 60/525 |
| 2,616,245 | 11/1952 | Van Weenen | 60/525 |
| 3,157,024 | 11/1964 | McCrory | 60/525 |
| 3,296,808 | 1/1967 | Malik | 60/520 |

*Primary Examiner*—Allen M. Ostrager

*Attorney, Agent, or Firm*—Merriam, Marshall & Bicknell

[57] ABSTRACT

A multi-cycle thermal reciprocating machine of the type commonly known as Stirling engine, which operates on a closed cycle with a compressible fluid as the operational medium. Double-acting pistons are combined into reciprocating members, each of which is in contact with the operational medium of at least four different Stirling cycles. These cycles occur simultaneously and are symmetrically phased, each performed in at least two different expansible chambers at two different temperatures, typically one hot expansion chamber connected to a cold compression chamber through a conduit containing two heat exchangers and one regenerator. The piston surfaces are arranged in opposed pairs, two pairs of surfaces being maintained at a constant distance apart and so located that the movement of each reciprocating member is caused by one co-acting pair of expansion chambers being part of one pair of thermodynamic cycles in phase opposition to each other, and a second co-acting pair of compression chambers being part of a second pair of cycles also in phase opposition to each other, and in a quadrature relationship with the first pair of cycles. Each cycle is effected by two reciprocating members in such a manner that the compression forces of one cycle are internally balanced by the expansion forces of another cycle, so that in consequence there is a smooth flow of power and the forces transmitted are reduced. The resulting Stirling engines are flexible in design and versatile in application.

16 Claims, 6 Drawing Figures

METHOD AND DEVICE FOR BALANCED COMPOUNDING OF STIRLING CYCLE MACHINES

BACKGROUND OF THE INVENTION

1. Field of the Invention

This invention relates to a multicycle Stirling engine comprising four or more systems of interconnected expansible chambers, each system including one or two expansion chambers and one compression chamber. In each system there is a phase difference between the volume variations of the compression chamber and the volume variations of the expansion chamber which communicate with each other through a conduit with heat exchanging sections. Each system is charged with a compressible operational medium, such as a permanent gas, which is adapted to flow back and forth between the chambers through the above conduit.

If this medium conveys heat from a higher temperature level to a lower temperature level, this medium being heated, for example by a burner and cooled by a coolant, such as water, the Stirling engine is capable of converting heat into mechanical energy, so that the machine performs an engine cycle and operates as a hot gas engine. If on the contrary this medium conveys heat from a lower temperature level to a higher temperature level, for example from a space to be cooled to a coolant, for example water at ambient temperature, the machine is capable of converting mechanical energy or heat energy into cold, so that a refrigerating cycle is performed and the machine acts as a cold gas refrigerator. If the medium simultaneously performs an engine cycle and also a refrigerating cycle, then the machine acts as a heat-operated heat transporting device.

In particular this invention relates to improved means of performing the desired thermodynamic cycles for the operational medium in such devices through compounding of the constituent cycles in a multi-cycle machine, using pairs of double-acting pistons rigidly connected to each other, each of which is in communication with the operational medium of at least four separate thermodynamic cycles.

2. Description of the Prior Art

Single cycle Stirling engines were in common use about one hundred years ago. Although many different types have been made, they have not proved competitive with other thermal machines to continue to be used. Due to the shortcomings of known Stirling cycle machines, they are presently being made only for experimental purposes as engines and only in limited numbers as refrigerators.

Multi-cycle Stirling engines known to the art are more compact and have a higher mechanical efficiency and specific power. However, output from individual pistons is not balanced, and a heavy duty crankshaft or a swashplate is needed to coordinate the pistons and transmit the load. Examples of these are described in the following U.S. Pat. Nos. 2,611,235 to F. L. van Weenen, 2,657,553 to C. O. Jonkers, 2,724,248 to T. Finkelstein, 3,527,049 to V. Bush and 3,538,706 to R. R. Toepel.

Up to about fifteen years ago nearly all Stirling engines had mechanical output delivered from an engine, or supplied to a refrigerator, through a rotating shaft connected to the reciprocating members attached to the pistons at one end and to a rotating crankshaft at the other end. Each of the main reciprocating members of a Stirling engine was therefore linked to the rotating crankshaft and the phase relationship between the reciprocating members was predetermined. One notable exception was U.S. Pat. No. 2,558,481 to A. A. Dros; however since energy flow in this design is not balanced, stable operation was difficult to achieve.

A tuned free-piston single-cycle Stirling engine without such linkage was disclosed by U.S. Pat. No. 3,552,120 to W. T. Beale, but its maximum power is limited to two thousand watts. An engine using bellows and tuned electrical circuits with a resonant mechanical spring-mass system is described in U.S. Pat. No. 3,548,589 to E. H. Cooke-Yarborough. However this is only suitable for powers of up to twenty watts.

Since Stirling engines have the inherent advantage of high efficiency, much research has been done to develop Stirling engines that would be competitive with internal combustion engines. In recent years intensified air pollution problems and increased government pollution controls have also increased research in the field. Yet they are still not commercially produced and no competitive Stirling cycle machine has been developed to date. Engines that were known to prior art with mechanical transmission were complicated, bulky and expensive, while those that used free pistons were limited to single cycles and a low power output. In contrast, the principle disclosed by this invention leads to considerable simplification and increase in performance, as well as reduction in size and cost.

SUMMARY OF THE INVENTION

A first object of this invention was to improve the performance of Stirling engines and simplify their construction through a new combination of simultaneous cycles in one engine, reducing the forces acting on each reciprocating member and substantially evening out power fluctuations. This increases the efficiency and the performance of heavy duty Stirling engines or refrigerators with rotary power output shafts through the more efficient arrangement of the constituent cycles by balanced compounding.

A second object was to achieve an efficient free piston form of a Stirling engine, eliminating the need for crankshafts, connecting rods, swashplates and flywheels and to adapt them for compressing gases or vapors and for producing electric power through the use of reciprocating electromagnetic generators.

A third object was to extend the known uses of Stirling engines from power producers and refrigerators to one further field of application: that of heat-actuated heat transporting devices for heating buildings in winter and for cooling them in the summer.

Simple versions of this invention operate as an engine with four distinct and separate thermodynamic systems, performing four Stirling cycles simultaneously. In each system the operational medium is successively expanded, principally in the expansion chamber, absorbing heat from a heat source. It is then regeneratively cooled and then compressed, principally in the compression chamber, evolving heat which is rejected to a heat sink and finally regeneratively heated, thus completing the cycle. The expansion chamber and the compression chamber in each system are expansible chambers in open communication with each other through a conduit with sections arranged for heat transmission from or to the operational medium. The section of the conduit adjacent to the expansion chamber, where most of the heat addition to the operational medium from the external heat source occurs, is referred to here as the heater; the section of the conduit adjacent to the compression chamber, where most of the heat rejection from the operational medium to the external heat sink occurs, is referred to as the cooler. There is also a regenerator between the heater and the cooler for heat storage. The phase difference between the volume variations of the expansion chamber and the volume variations of the compression chamber in each system is preferably one quarter a cycle, but in general may vary between one sixth and one third of a cycle.

The volumes of the expansible chambers are varied by means of reciprocating members comprising pairs of rigidly connected double-acting pistons. A first upper piston face is exposed to the expansion chamber of a first cycle, and a first lower piston face is exposed to the expansion chamber of a second cycle in direct phase opposition to the first cycle. A second upper piston face is exposed to the compression chamber of a third cycle in quadrature phase relationship with the first cycle and a second lower piston face is exposed to a fourth cycle in direct phase opposition to the third cycle. The term direct phase opposition means that the time-variable parametric changes of volume, pressure, temperature and mass flow in the two thermodynamic cycles referred to are all out of phase by one half the periodic time, and the term quadrature phase relationship means that these changes are all out of phase by one quarter the periodic time.

In the simple versions of this invention four simultaneous Stirling cycles are compounded so that each reciprocating member is in contact with the operational medium of four thermodynamic cycles, each of which is in quadrature relationship with two other cycles. While in Stirling engines known to the art external power has to be supplied to maintain the compression process, which necessitates heavy mechanical connections and a flywheel, with this invention the compression process is internally balanced by the expansion process and only the difference in work between these two processes is transmitted by the mechanism. Each reciprocating member is balanced because at each instant, and at each incremental position, a force in the direction of motion acts upon it. This makes all the embodiments of this invention self-starting and it also substantially reduces the mechanical strength needed for the machine elements.

Due to this balanced compounding it is possible in preferred embodiments of this invention to eliminate the link mechanism, which in most Stirling engines known to the art is attached to the reciprocating members, so that the reciprocating members can function as free pistons. Applicant has found that in this free piston operational mode the desired quadrature relationship between the movements of the reciprocators can be established without additional machine elements or control mechanisms. With a correct choice of the disposition of the doubleacting pistons and the conduits connecting the operational chambers, as explained in detail later, the correct phasing between the reciprocating members is the result of even energy flow into each reciprocating member with a symmetrical cyclic disposition of the constituent cycles. A preferred choice for the number of cycles is four, in which case a quadrature relationship always exists between the movements of the reciprocating members.

Applicant has also found through a rigorous analytical and experimental investigation, the details of which are too complex to include in these specifications, that any tendency to depart from the desired quadrature relationship in a machine leads to an imbalance which is a highly damped transient so that the mechanism rapidly returns to the desired quadrature relationship. Stable operating conditions exist only when all the reciprocating members oscillate with the same frequency and when their phasing is such as to lead to a quadrature phase relationship in the four constituent cycles. In summary, the balanced compounding taught by this invention eliminates the need for external mechanical coordination of the reciprocating members and also the need for kinetic energy storage in a flywheel, since the reciprocating members can be made self-coordinating and the flow of power is substantially smooth with no negative power periods. Correct phasing is thus the result of the balanced compounding and the machine is unconditionally stable at all speeds and independent of the mass-spring characteristics of the device.

In some applications, for example for the propulsion of road vehicles, a mechanical rotary transmission may still be a requirement and in these instances either crankshafts or swashplates may be used with various embodiments of this invention; however these machines can be made substantially lighter and cheaper than machines known to the art on account of the reduced forces acting on the mechanism.

As will be apparent from the following more detailed explanation, this invention overcomes the difficulties and the limitations of the prior art and provides Stirling engines of greater efficiency, specific power and range of capabilities. The full advantages will be readily understood from the description of the various embodiments of the invention. However the general advantages of all the embodiments, regardless of whether the compounding taught by this invention is used with a mechanical transmission or with free pistons, are summarized first:

1. The pressure forces are balanced internally, so that the dimensions for the piston rods and for other machine components can be reduced to make the engine cheaper and lighter and to increase the mechanical efficiency. The net output forces transmitted are also reduced, so that the engine becomes quieter and more stable.

2. The reduction in the dimension of the piston rods reduces the inter-cycle leakage which further increases the power output.

3. As a result of the internal balancing of the pressure forces it is permissible to utilize higher pressures in this machine than in machines hitherto known, which again favorably affects the efficiency and the specific power of the machine.

4. Due to the internal balancing of forces there is a more even flow of power; no flywheel is needed and the machine is self-starting in all positions.

The general advantages of the invention for specific embodiments using free pistons are summarized next:

1. Only reciprocating parts are used and there are no rotating elements or machine parts with rotary oscillatory motion. This results in still further simplification and reduction in cost; for example, the preferred embodiments have only two moving elements. As a result of this simplification still higher efficiency and specific power is obtained.

2. Operation is independent of resonant speed as a function of mass and effective spring rate and there is therefore stability at all operational speeds.

3. Since there is no external output shaft, no gas seals between moving surfaces is needed and the enclosure can be hermetically sealed. Hence there is no leakage loss of the operational medium.

4. No displacers are needed and the coordination of coacting reciprocating members is entirely automatic.

5. The compactness of the engine permits the use of simple energy transmission devices such as reciprocating electric generators or inertia pumps.

6. With direct coupling between cycles it is possible to construct heat-actuated heat transporting devices which is not practical with Stiring engine known to the art.

BRIEF DESCRIPTION OF DRAWINGS

For a more comprehensive understanding of the nature and the objects of the invention, reference should be made to the following detailed description of six embodiments taken in connection with the accompanying drawings in which.

DESCRIPTION OF THE PREFERRED EMBODIMENT

Figure 1:
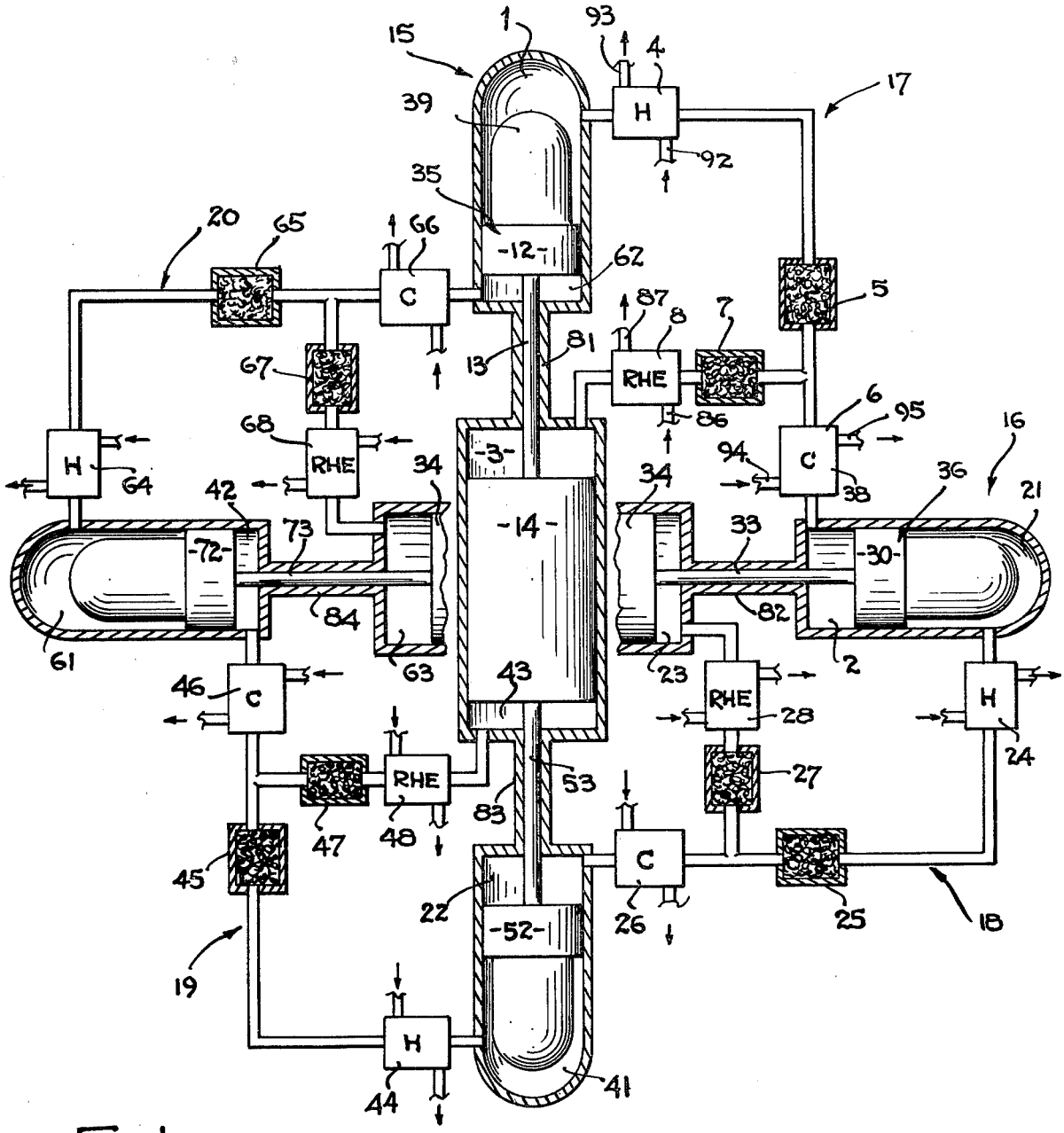
FIG. 1 is a schematic cross-sectional view of a preferred embodiment of the invention, partly broken away for greater clarity, which is a four-cycle heat-actuated heat transporting device with two crossed cylinders.

FIG. 1 illustrates the use of this invention as a heat transporting device for heating buildings in winter and for cooling them in summer. This first embodiment comprises two cylinder assemblies 15 and 16, containing the two reciprocating members 35 and 36, and the interconnecting conduits 17, 18, 19 and 20. The cylinder assemblies 15 and 16, together with the conduits 17, 18, 19 and 20 form a sealed gastight enclosure containing Helium gas at a mean pressure of thirty atmospheres. The two reciprocating members 35 and 36 are mounted within the cylinder assemblies 15 and 16 for axial reciprocation. These cylinder assemblies 15 and 16 are located with their center lines in parallel planes to provide minimum clearance between each other, with the projections of the centerlines forming a right angle on parallel planes. The cylinder assembly 15 and the reciprocating member 35 fitted within it are identical to the cylinder assembly 16 and the reciprocating member 36 fitted within it. Cylinder assemblies 15 and 16 are shown in longitudinal cross-section with the central portion of cylinder assembly 16 and reciprocating member 36 partly broken away for clarity.

The gastight enclosure comprising the two cylinder assemblies 15 and 16, and the four conduits 17, 18, 19 and 20 is hermetically sealed from the outside. This enclosure is subdivided by the reciprocating members into four separate thermodynamic systems, so that four separate Stirling cycles can be performed simultaneously. Cylinder 15 comprises three coaxial cylindrical chambers for the accommodation of the three double-acting piston portions 12, 14 and 52 of reciprocating member 15. Similarly, cylinder 16 accommodates the double-acting piston portions 30, 34 and 72 of the reciprocating member 36. Each of these pistons forms a closely machined fit in the cylindrical bore of the chamber in which it reciprocates so as to minimize leakage. The reciprocating member 35 has thin piston rods 13 and 53 keeping the pistons a constant distance apart, which also are a closely machined fit inside the piston rod tubes 81 and 83 of cylinder assembly 15. Similarly piston rods 33 and 73, being parts of the reciprocating member 36, are a closely machined fit in the piston rod tubes 82 and 84 of cylinder assembly 16. Leakage of helium along the tightly fitting pistons and the piston rods connecting them is minimal so that the quantity of helium in each of the four thermodynamic systems is substantially constant.

Piston 12 divides the chamber in which it reciprocates into two subchambers 1 and 62, and it will be shown that subchamber 1 functions as an expansion chamber, and subchamber 62 as a compression chamber. Similarly piston 14 divides the chamber in which it reciprocates into the two expansion chambers 3 and 43 and piston 52 divides the chamber in which it reciprocates into expansion chamber 41 and compression chamber 22. In a similar manner piston 30 defines expansion chamber 21 and compression chamber 2; piston 34 defines the expansion chambers 23 and 63 and piston 72 defines the expansion chamber 61 and the compression chamber 42.

The above twelve variable-volume subchambers are interconnected by conduits 17, 18, 19 and 20, all identical in construction and each comprising sections that function as heat exchangers between the helium inside the system and the heat transfer medium outside, hereinafter termed heaters, coolers and refrigerating heat exchangers, depending upon their function, and sections that function as thermal regenerators, hereinafter termed high-temperature regenerators or low temperature regenerators, depending upon their temperature range. The sections of conduit 17 will be described in greater detail next, noting that the sections of conduits 18, 19 and 20 are identical to the sections of conduit 17. Located in the conduit 17 and associated with it as integral parts are a heater 4, a high-temperature regenerator 5 and a cooler 6 in a main passage connecting subchamber 1 to subchamber 2, and low-temperature regenerator 7 and refrigerating heat exchanger 8 in a branch passage to subchamber 3.

The heater 4 may be any suitable apparatus for introducing thermal energy at high temperature into the operational medium, such as a heat exchanger suitable for circulating combustion gases in out-of-contact heat exchange by way of inlet 92 and outlet 93. This heat transfer maintains the helium gas in the expansion chamber at a high temperature and in order to protect the sliding surface of piston 12 from the deleterious effects of this high temperature, an insulating cap 39 is fitted to the piston 12.

The high temperature regenerator 5 is a chamber filled with a matrix made of distributed wire of less than 0.01 cm in diameter and a filling factor of less than twenty five percent. This presents a relatively large surface area to the helium flowing back and forth through the regenerator, and it is capable of maintaining an axial temperature gradient in the helium gas between the heating temperature and the cooling temperature.

The cooler 6 may be a heat exchanger suitable for circulating a coolant fluid such as water near ambient temperature by way of inlet 94 and outlet 95 in out-of-contact heat exchange with the operational medium of the cycle.

The low-temperature regenerator 7 is similar in construction and operation as the high-temperature regenerator 5 and is capable of maintaining an axial temperature gradient between the cooling temperature and the refrigerating temperature. The refrigerating heat exchanger 8 may be a heat exchanger suitable for circulating a refrigerating fluid, such as brine at a relatively low temperature, by way of inlet 86 and outlet 87. This brine serves as the heat transport fluid used to cool the interior of a house in summer or to pick up environmental heat energy from the outside in winter. The exact manner in which the hot, ambient or cold heat exchange fluids are furnished is within the skill of the art and is not part of the invention. The construction of the heat exchange components 4, 5, 6, 7 and 8 is similar to that used in Stirling engines known to the art and further details of their features can be found in the open literature.

The first of four thermodynamic systems comprises the two expansion chambers 1 and 3, the compression chamber 2 and the conduit 17, which conduit comprises the following parts: one main passage with the heater 4, high-temperature regenerator 5 and cooler 6 between the expansion chamber 1 and the compression chamber 2, and a branch passage with the refrigerating heat exchanger 8 and the low temperature regenerator 7 in series between the expansion chamber 3 and a point between the high temperature regenerator 5 and the cooler 6. A second thermodynamic system comprises the two expansion chambers 21 and 23, the compression chamber 22 and conduit 18, where the individual components of conduit 18 are identical to those of conduit 17 and their location can be inferred by symmetry; heater 24 corresponds to heater 4, high temperature regenerator 25 corresponds to high temperature 5 and so forth. The third and fourth thermodynamic systems are similar to the first and second and can also be inferred by symmetry. The corresponding components in the four systems are therefore the following:

Four high temperature expansion chambers 1, 21, 41 and 61;
Four heaters 4, 24, 44, and 64;
Four high-temperature regenerators 5, 25, 45 and 65;
Four coolers 6, 26, 46 and 66;
Four compression chambers 2, 22, 42 and 62;
Four low-temperature regenerators 7, 27, 47 and 67;
Four refrigerating heat exchangers 8, 28, 48 and 68;
Four low temperature expansion chambers 3, 23, 43 and 63.

The operational mode of the machine is as follows: When the heaters 4, 24, 44 and 64 are maintained at a high temperature by the combustion process, and when the coolers 6, 26, 46 and 66 are maintained near ambient temperature by the cooling water flow, the heat transfer causes dynamic changes in the pressure of the helium which supplies the energy to maintain the reciprocating members 35 and 36 in a state of stable oscillations with the same frequency and stroke, but with a relative phase displacement of ninety degrees, termed a quadrature relationship. The effect of this oscillation is twofold: Firstly, it establishes the kinematic conditions where four Stirling cycles are performed in the four thermodynamic systems and in consequence of this the eight expansible chambers 1, 21, 41, 61, 3, 23, 43 and 63 function as expansion chambers where heat is absorbed during the expansion process and the four expansible chambers 2, 22, 42 and 62 function as compression chambers where heat is rejected during the compression process. Secondly it causes heat to be absorbed from the combustion gases in the heaters 4, 24, 44 and 64 and also from the brine in the refrigerating heat exchangers 8, 28, 48 and 68 while heat is rejected to the cooling water in the coolers 6, 26, 46 and 66.

It can be readily seen that a modified Stirling cycle is performed in the system comprising (a) a high temperature segment, comprising hot expansion chamber 1 and heater 4, (b) an intermediate temperature segment, comprising compression chamber 2 and cooler 6, (c) a low temperature segment, comprising cold expansion chamber 3 and refrigerating heat exchanger 8, (d) regenerator 5 between the high and the intermediate temperature segments, (e) regenerator 7 between the intermediate and the low temperature segments.

This first Stirling cycle is thus performed in spaces 1 through 8 and three additional equivalent Stirling cycles are performed in spaces 21 through 28 for the second cycle, 41 through 48 for the third cycle and 61 through 68 for the fourth cycle.

In practice the machine can be used to transfer heat from a low temperature level in the refrigerating heat exchangers 8, 28, 48 and 68 to the coolers 6, 26, 46 and 66 at an intermediate temperature level utilizing heat energy from heaters 4, 24, 44 and 64 at a high temperature level to maintain the process. The machine therefore functions as a heat transporting device.

It will be readily understood that there are other different configurations of cylinders and reciprocating members with suitably connected conduits which will yield the desired operational mode and a general rule for making appropriate connections for all embodiments of the invention to result in the required balanced compounding claimed by this invention has been derived by applicant which depends upon the number of reciprocating members. For the special case where the number of reciprocating members is two, as in the peferred embodiment, this same rule also applies to the second, third and fourth embodiment, which will be described next before explaining this rule in detail.

For the comfort cooling and heating of buildings, the complete installation utilizing this embodiment includes airconditioning heat exchangers inside the building and an environmental heat exchanger outside the building, together with suitable piping to form liquid loops between these external heat exchangers and the heat exchangers such as 6 and 8, and pumps to circulate the water and the brine around the loops. The gas burned in the combustion chambers to enter 92 is preferrably utilized in conjunction with recuperative burners so as to utilize the maximum of the available thermal energy in the gas.

In winter the brine circulating around the refrigerating heat exchangers 8, 28, 48 and 68 is connected to the environmental heat exchanger, so that heat is absorbed by the brine from the cold environment, typically at a temperature of minus thirty degrees centigrade, and is transferred to the helium at the refrigerating heat exchangers 8, 28, 48 and 68. The water circulating around the coolers 6, 26, 46 and 66 is connected to the airconditioning heat exchanger, so that heat is absorbed by the water from the helium at the coolers, typically at a temperature of fifty degrees centigrade, and transferred to the air inside the building. Applicant has computed that for each calorie of heat energy developed at the burners, 2.5 calories can be delivered to the house in terms of a heating effect.

In summer the brine circulating around the refrigerating heat exchangers 8, 28, 48 and 68 is connected to the airconditioning heat exchangers so that heat is transferred from the ambient air inside the building to the helium in the tubes of the refrigerating heat exchangers, typically at a temperature of twenty degrees centigrade. The water circulating around the coolers 6, 26, 46 and 66 is connected to the environmental heat exchanger so that heat is absorbed from the helium in the tubes of the coolers and is rejected to the environment outside the building, typically at a temperature of fifty degrees centigrade. Applicant has computed that for this case for each calorie of heat energy developed at the burners, a cooling effect of 0.6 calories is obtained.

DESCRIPTION OF A SECOND EMBODIMENT

Figure 2:
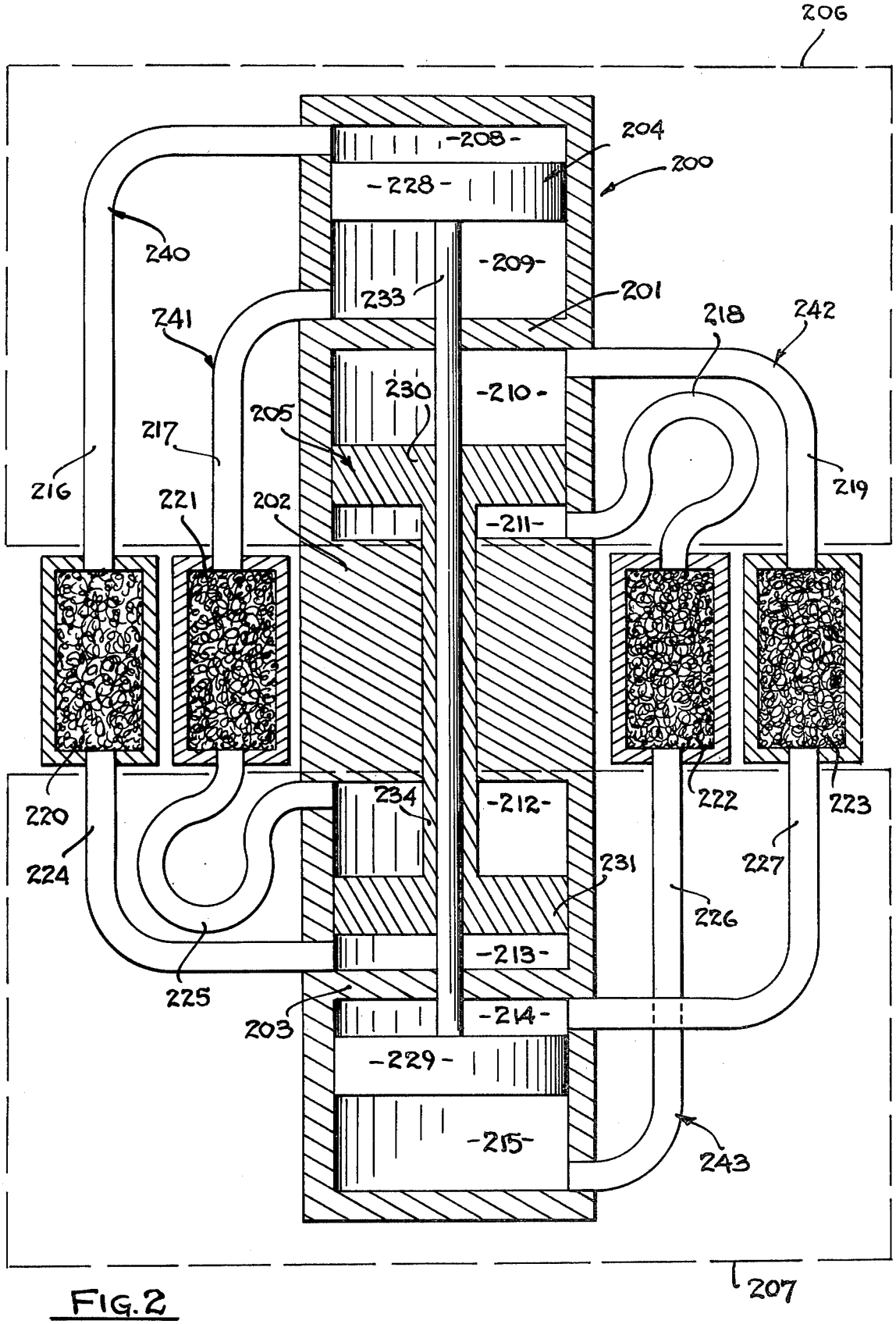
FIG. 2 is a schematic cross-sectional view of a second embodiment of the invention, which is a four-cycle engine with one cylinder.

FIG. 2 illustrates a second embodiment operating as a simple solar heat engine. It generally consists of a cylinder 200, conduits 240, 241, 242 and 243 and two reciprocating members 204 and 205. Cylinder 200 has an internal cylindrical chamber subdivided by three internal partitions 201, 202 and 203 and by four double-acting pistons 228, 229, 230 and 231 into eight expansible subchambers 208, 209, 210, 211, 212, 213, 214 and 215. The operational medium, which is air compressed to a mean pressure of five atmospheres, is contained in all the internal spaces comprising the above eight subchambers and the four conduits.

The reciprocating member 204 comprises the two pistons 228 and 229 connected by the thin piston rod 233 and the reciprocating member 205 comprises the two pistons 230 and 231 and the hollow tubular piston rod 234. The pistons and piston rods are arranged to slide with their cylindrical guiding surfaces closely fitting so that leakage of the operational medium along them is minimized. The upper part of the engine, as indicated by the dashed line 206, is heated by radiated solar energy and the lower part, as indicated by the dashed line 207, is kept cool by circulating cooling water around it.

The upper four expansible chambers 208, 209, 210 and 211 function as expansion chambers and the lower four expansible chambers 212, 213, 214 and 215 function as compression chambers. Each expansion chamber is connected to one compression chamber via a conduit, which conduits comprise heaters 216, 217, 218 and 219, regenerators 220, 221, 222 and 223 and coolers 224, 225, 226 and 227. The heaters, such as 216, are thin pipes leading from the expansion chambers to the regenerators and radiative energy from the sun is allowed to heat up the outer surfaces of these pipes whence the heat is transferred to the internal pressurized air.

The two reciprocating members oscillate with the same frequency in quadrature phase relationship. In each of the four constituent systems comprising sets of chambers such as that made up of expansion chamber 208, heater 216, regenerator 220, cooler 224 and compression chamber 213, one thermodynamic cycle equivalent to that occurring in a conventional single cycle Stirling engine is carried out. The machine is therefore a four-cycle machine where four simultaneous cycles occur simultaneously.

As a result of the mechanical oscillation, some of the heat energy is converted to mechanical energy. This mechanical energy is utilized by allowing the whole machine to oscillate up and down, thus actuating a pumping mechanism, or alternatively, linear electric generators are attached to the pistons inside the machine, or as yet another method of energy extraction, inertia pumps may be mounted in the machine.

DESCRIPTION OF A THIRD EMBODIMENT

Figure 3:
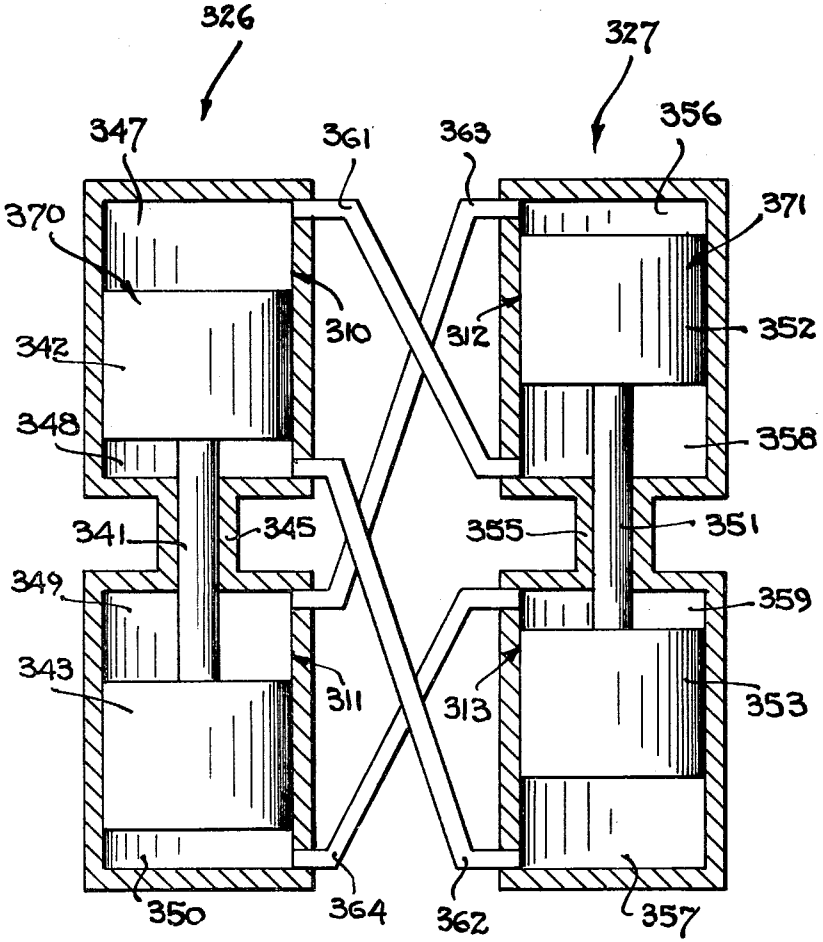
FIG. 3 is a schematic cross-sectional view of a third embodiment of the invention, which is a four-cycle engine with two parallel cylinders and plain pistons.

FIG. 3 illustrates a third embodiment as an engine with two parallel cylinders and two pairs of plain double-acting pistons. It generally consists of cylinders 326 and 327, conduits 361, 362, 363 and 364, reciprocating members 370 and 371 with compressed gas as the operational medium filling the internal spaces. Cylinder 326 has two coaxial cylindrical chambers 310 and 311 connected by the tubular piston rod guide 345, and cylinder 327 has two cylindrical chambers 312 and 313, connected by the tubular piston rod guide 355. The first reciprocating member 370 comprises two double-acting pistons 342 and 343, connected by the thin piston rod 341 with closely fitting machined cylindrical sliding surfaces to minimize leakage of the operational medium along these surfaces. The construction of the second reciprocating member 371 is identical to that of the first, comprising pistons 352 and 353 and piston rod 351. Four expansible operational chambers are thus defined inside cylinder 326 by the first reciprocating member 370: two expansion chambers 347 and 350, and two compression chambers 348 and 349. Similarly the second reciprocating member 371 defines in the second cylinder 327 the following four expansible operational chambers: expansion chambers 356 and 357 and compression chambers 358 and 359. All the expansion chambers are heated, and all the compression chambers are cooled. Each of the four conduits 361, 362, 363 and 364 connects one expansion chamber to one compression chamber. The details of a heater, regenerator and cooler section in each conduit are omitted from FIG. 3 for clarity but it will be understood that they may be present in the manner explained in detail with reference to the first two embodiments. This third embodiment is suitable for general use as a hot gas engine or a cold gas refrigerator in either free pistons form as shown, or else with a link mechanism connecting the pistons to a rotary output shaft.

DESCRIPTION OF A FOURTH EMBODIMENT

Figure 4:
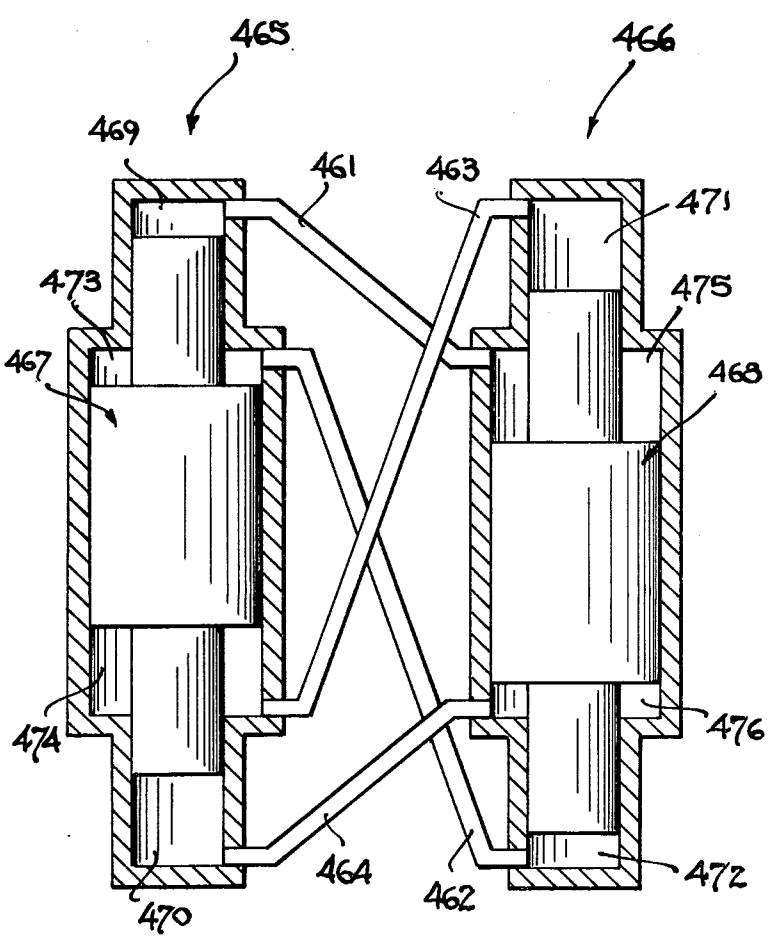
FIG. 4 is a schematic cross-sectional view of a fourth embodiment of the invention, which is a four-cycle engine with two parallel cylinders and stepped pistons.

FIG. 4 illustrates an embodiment which is generally similar to the third embodiment, but it uses stepped pistons instead of pairs of double-acting pistons. Cylinder 465 and 466 and the two reciprocating members 467 and 468 each have three cylindrically shaped parts of different diameters defining the expansion chambers 469, 470, 471 and 472 with a smaller diameter at the outer ends, and the compression chambers 473, 474, 475 and 476 with a large diameter at the inner ends of the assembly. The cooperating cylindrical surfaces are a close sliding fit and in general the other constructional features of this embodiment are similar to the third embodiment. For simplicity the four conduits 461, 462, 463 and 464 are again shown with no separate heat transfer sections.

One common feature shared by the first four embodiments is that each has two reciprocating members and four simultaneous cycles, but the arrangement of the chambers and of the interconnecting conduits is different for various embodiments. Through a computer analysis of the forces acting in generalized four-cycle Stirling engines, applicant has established that the optimum balancing of forces is obtained when each reciprocating member is acted upon by the pressure forces of two expansion chambers and two compression chambers, where the two expansion chamber volumes vary in direct phase opposition to each other, the two compression chamber volumes also vary in direct phase opposition to each other, and where the first expansion chamber pressure and the first compression chamber pressure vary in a quadrature relationship. In those embodiments where there are two expansion chambers in each cycle, as for example in the first embodiment, the volumes of these two chambers must vary in phase with each other. For all embodiments with two reciprocating members the general rule for interconnecting the chambers has been found to be the following:

Compression chambers defined by the first reciprocating members are connected to chambers with the same orientation and compression chambers defined by the second reciprocator are connected to chambers with a different orientation. To define the term orientation, a distinction is made between an upright chamber, which is situated above the piston which defines it, and an inverted chamber, which is situated below the piston which defines it. Two chambers have the same orientation if they are both upright, or alternatively, they are both inverted. Two chambers have different orientations if one is upright and the other is inverted. In embodiments such as the one shown in FIG. 1, wherein one of the reciprocating members is not vertical, one end must arbitrarily be defined as the upper end.

As an example of the application of this rule, making reference to the second embodiment in FIG. 2, two compression chambers 214 and 215 are defined by the first reciprocating member 204 and they communicate with expansion chambers 210 and 211 to form pairs of chambers, both chambers in a pair being either above or below the associated piston faces, and therefore having the same orientation. The two compression chambers 212 and 213 defined by the second reciprocating member 205 communicate with the two expansion chambers 209 and 208, forming two pairs of chambers and in each pair one chamber is above, and the other chamber is below the associated piston face. An examination of FIGS. 3 and 4 will show that the same rule for interconnection is also followed by the third and fourth embodiment.

With reference to the first embodiment and FIG. 1, the first reciprocating member is 35, and its upper end is the one shown near the top of the illustration. The second reciprocating member is 36. It has its upper end defined as the end pointing to the right in the illustration. The compression chamber 62 defined by the first reciprocating member 35 is connected to expansion chambers 61 and 63, all these three chambers being below their associated pistons. The compression chamber 22, also defined by the first reciprocating member, is connected to expansion chambers 21 and 23, all these three chambers being above their associated pistons. Referring now to the second reciprocating member 36, the compression chamber 2 defined by it is below its associated piston, and the two expansion chambers 1 and 3 connected to it are above their associated pistons. Similarly the second compression chamber 42 defined by the second reciprocating member 36 is above the associated piston, and the two expansion spaces 41 and 43 connected to it are below their associated pistons. In summary, compression chambers defined by reciprocating member 35 are connected to expansion chambers with the same orientation, and those defined by reciprocating member 36 are connected to expansion chambers of different orientation.

The four embodiments described are not the only possible configurations obeying this rule and it will be readily seen that there are further different embodiments with two reciprocating members.

DESCRIPTION OF A FIFTH EMBODIMENT

Figure 5:
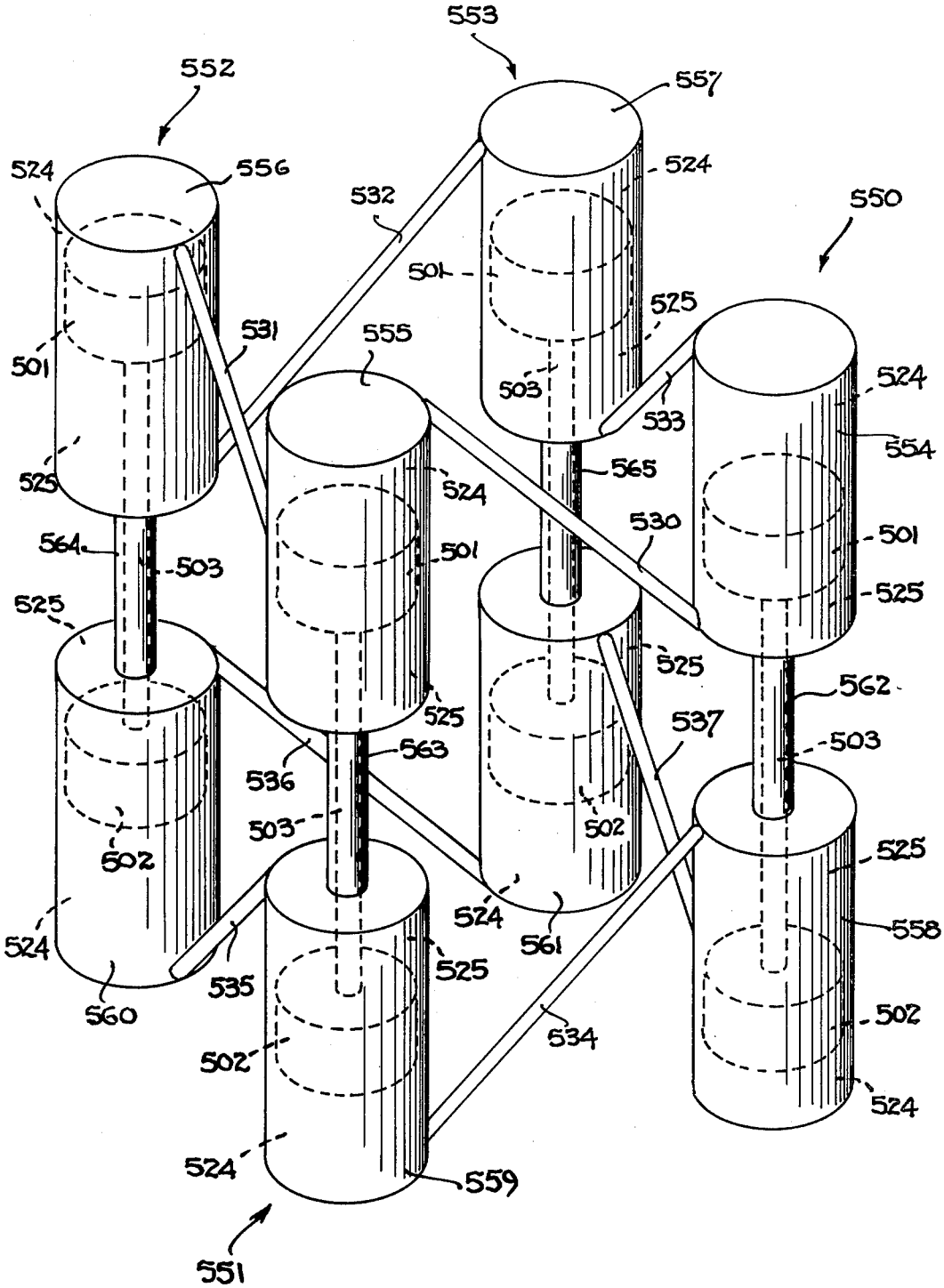
FIG. 5 is a schematic perspective view of a fifth embodiment of the invention, which is an eight-cycle engine with a symetrical cluster of four parallel cylinders.

FIG. 5 is a perspective view of a fifth embodiment, an engine where the cylinders are arranged in a symmetrical cluster, and where the cycles form two closed chains of four cycles each. There are four identical cylinder assemblies 550, 551, 552, and 553 comprising upper cylinders 554, 555, 556, and 557 and lower cylinders 558, 559, 560 and 561 connected by the piston rod guide tubes 562, 563, 564 and 565. Within these cylinder assemblies four identical reciprocating members are mounted as indicated by dotted lines in the drawing, each consisting of two double-acting pistons 501 and 502 connected by a thin piston rod 503. The center lines of the cylinder assemblies are parallel and symmetrically disposed on a cylindrical surface.

The expansion chambers 524 are located at the outer end of each cylinder, while the compression chambers 525 are located at the inner end of each cylinder. The interconnecting conduits 530 through 537 between the operational chambers are located as follows. Looking at the cluster of cylinders from above and proceeding in a clockwise direction, then for the upper and lower set of four cylinders each compression chamber is connected to the expansion chamber of the following cylinder. Thus conduit 530 connects the compression chamber of cylinder 554 to the expansion chamber of cylinder 555, conduit 531 connects the compression chamber of cylinder 555 to the expansion chamber of cylinder 556 and so forth.

The embodiment shown in FIG. 5 is one of several designs using more than two reciprocating members with cyclic interconnections. It was found that three, four, five or six reciprocating members may be used and the following rule applies: If the reciprocating members are consecutively numbered, then a compression chamber defined by one reciprocating member is connected to an expansion chamber defined by the next consecutive reciprocating member and a compression chamber defined by the last reciprocating member is connected to the expansion chamber defined by the first reciprocating member. Each pair of connected chambers may have opposite orientation throughout the assembly, as in the case in the fifth embodiment illustrated and described, where in each pair one chamber is above the associated piston and the other is below. Alternatively, in different embodiments, if the number of reciprocating elements is even, then pairs of chambers with the same orientation may be interconnected throughout the assembly, both chambers being either above or below their associated pistons. It will be readily understood that instead of placing the cylinder assemblies in a circular cluster, it is also possible to place them in parallel witn their center lines in one plane, but the conduit connecting the chambers in the two cylinders at the outer ends becomes relatively long. Radial configurations are also feasible.

DESCRIPTION OF A SIXTH EMBODIMENT

Figure 6:
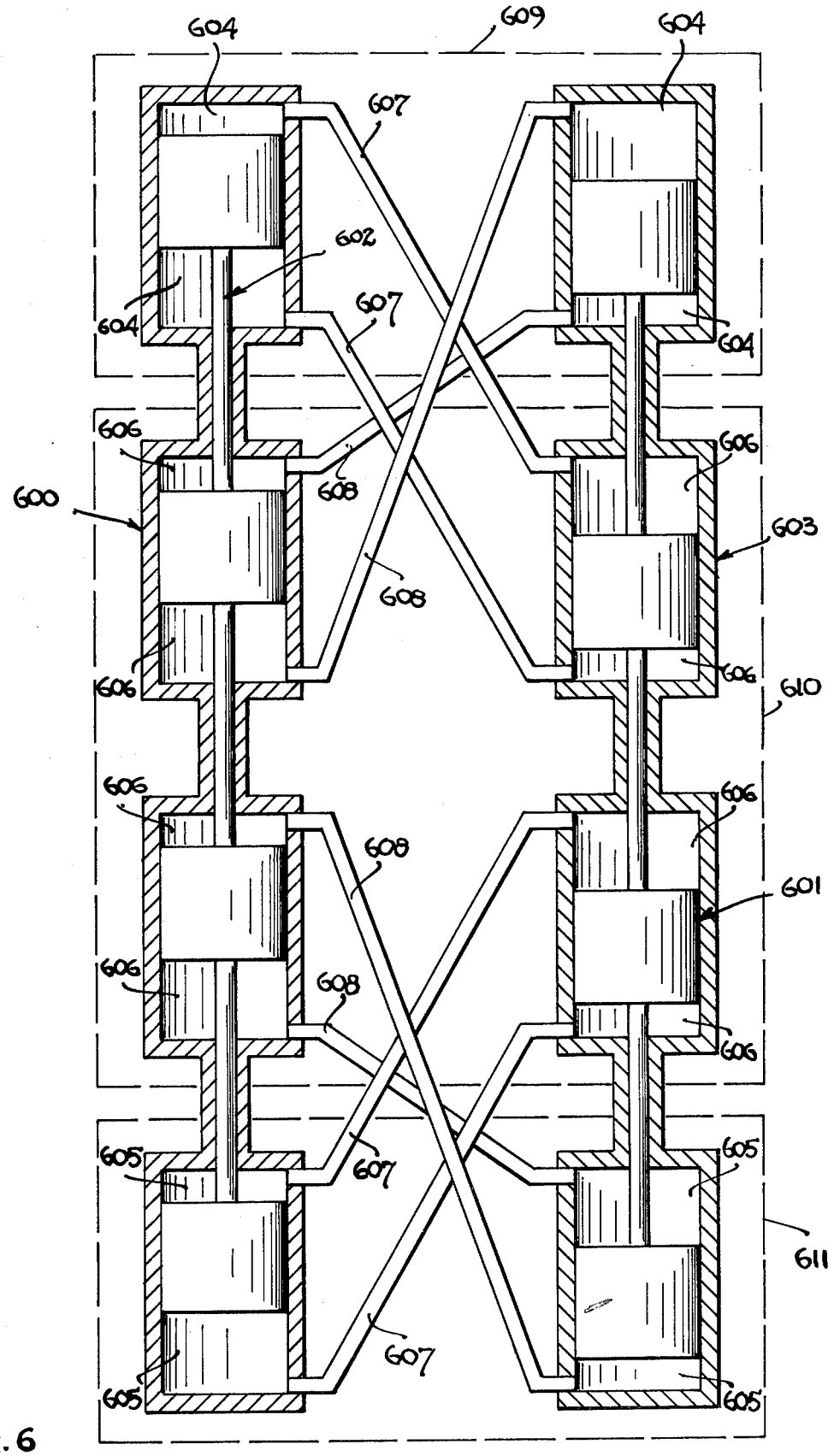
FIG. 6 is a schematic cross-sectional view of a sixth embodiment of the invention which is a combined four-cycle engine and a four-cycle refrigerator with two parallel cylinders acting as a heat-actuated heat transporting device.

FIG. 6 illustrates a sixth embodiment where eight constituent Stirling cycles are utilized in a heat transporting device. It generally consists of cylinder assemblies 600 and 601 with four chambers each, in which double-acting pistons reciprocate. These double-acting pistons are connected by piston rods to form reciprocating assemblies 602 and 603. There are two sets of expansion chambers: four chambers 604 maintained at a relatively high temperature, such as that obtained by the combustion of a fuel, and four chambers 605 maintained at a relatively low temperature of refrigeration. Eight compression chambers 606 are maintained at a temperature of heat rejection between the temperatures of chambers 604 and 605. The conduits 607 and 608 interconnecting pairs of expansion chambers and compression chambers are as shown in FIG. 6, made in accordance with the rule explained with reference to the first four embodiments, 607 connecting chambers with the same orientation and 608 chambers with different orientations. There are three distinct temperature zones as indicated by the dashed lines 609, 610 and 611. In a typical application, 609 is the high temperature maintained by a combustion process, 610 is near ambient temperature for heat rejection, such as by cooling water, and 611 is near the temperature from which heat energy is to be transported to the higher temperature level of 610.

It will be seen from the above description of this invention that it provides a method and device which fulfills the objects set forth. By cyclic compounding, the greater part of the forces is internally balanced and this reduction in forces leads to greater efficiency. Moreover, the invention results in a range of novel machines based on free piston operation as described. There is, therefore, a combination of factors which materially contribute to the attainment of efficiencies higher than previously possible in Stirling engines, and which extends the range of applications.

Although the invention has been described by specific embodiments, it will be obvious to one skilled in the art that its teachings may be employed in other ways. Since certain changes may be made in carrying out the above method and in the construction set forth without departing from the scope of the invention, it is intended that all matter contained in the above description or shown in the accompanying drawings shall be interpreted as illustrative and not in a limiting sense. Thus the invention is not limited to the particular applications disclosed herein; rather, the scope of the invention is defined in the appended claims.

What I claim is:

1. In a method of operating a Stirling cycle machine incorporating a plurality of Stirling thermodynamic cycles each of which comprises the steps of successively expanding, cooling, compressing and heating a compressible operational medium, wherein each thermodynamic cycle is performed in an expansible compression space maintained at a first temperature and at least one interconnected expansible expansion space maintained at a different temperature, the improvement comprising:

arranging said spaces in a plurality of generally coaxial pairs separated by a double-acting reciprocating piston having two opposed surfaces, the first of which defines in part a first expansible space associated with one thermodynamic cycle and the second of which defines in part a second expansible space associated with a different thermodynamic cycle, the volume of said second space varying inversely with the volume of said first space, said pistons being arranged to form at least two reciprocable piston assemblies, each comprising at least two axially rigidly interconnected pistons, whereby reciprocating movement of each said assembly produces simultaneous variations in the volumes of at least four expansible spaces, exposing one surface of a first opposed pair of piston surfaces in an assembly to the time-variable pressure in the compression space of a first thermodynamic cycle, and exposing the second surface of said pair to the time-variable pressure in the compression space of a second thermodynamic cycle in phase opposition to said first cycle, whereby the forces exerted on said surfaces by said pressures are combined to produce a fluctuating output force acting along a straight line which is stationary in space.

2. A method in accordance with claim 1 wherein a first surface of a second pair of opposed piston surfaces is exposed to the time-variable pressure in the expansion space of a third thermodynamic cycle which is in quadrature phase relationship with said first cycle.

3. A method in accordance with claim 1 wherein a first surface of a second pair of opposed surfaces is exposed to the time-variable pressure in the expansion space of a third thermodynamic cycle, said first and third cycles having a phase difference of between one sixth and one third of a cycle.

4. A method in accordance with claim 1 wherein each thermodynamic cycle is performed in one expansible compression space at a first temperature, one interconnected expansible expansion space at a second temperature higher than said first temperature, and one interconnected expansible expansion space at a third temperature lower than said first temperature, wherein each piston assembly comprises at least three pairs of opposed surfaces, one piston surface of a first pair being exposed to the time-variable pressure in the compression space of a first thermodynamic cycle and the second surface of said first pair being exposed to the time-variable pressure in the compression space of a second thermodynamic cycle, said second cycle being in phase opposition to said first cycle.

5. A method in accordance with claim 4 wherein the first surface of a second pair of opposed piston surfaces is exposed to the time-variable pressure in the expansion space of a third thermodynamic cycle which is in quadrature phase relationship with the first cycle.

6. A method in accordance with claim 4 wherein the first surface of a second pair of opposed piston surfaces is exposed to the time-variable pressure in the expansion space of a third thermodynamic cycle, said first and third cycles having a phase difference between one sixth and one third of a cycle.

7. A Stirling cycle machine comprising in combination:

one or more cylinders each having means defining in part a plurality of internal chambers for the containment of a compressible operational medium;

at least two reciprocating members each comprising at least one pair of rigidly interconnected double-acting pistons, mounted for reciprocating movement within said chambers along a straight line which is fixed in space between a first position spaced a substantial distance from one end of said cylinders and a second position more closely adjacent to said end, each of said reciprocating members defining in part at least four expansible subchambers within said chambers, including a first upright subchamber, a first inverted subchamber, a second upright subchamber, and a second inverted subchamber, where the orientation of said subchambers is defined such that an upright subchamber has a maximum volume for said first position and a minimum volume for said second position, and an inverted subchamber has a minimum volume for said first position and a maximum volume for said second position;

means for maintaining said first upright and inverted subchambers at a first temperature, means for maintaining said second upright and inverted subchambers at a second temperature;

a plurality of conduit means for fluid flow interconnecting said subchambers to form thermodynamic systems for the performance of a plurality of Stirling cycles therein, said conduit means including an interconnection between each first subchamber and a second subchamber, said interconnected subchambers being defined in part by different reciprocating members; and heat exchange means for exchanging heat between said operational medium and external sources and sinks of heat.

8. A Stirling cycle machine in accordance with claim 7 wherein each of said conduit means comprises:

a cooler section directly communicating with a first subchamber, whereby the operational medium is placed in intimate thermal contact with a cooling heat sink at said first temperature;

a heater section directly communicating with a second subchamber, whereby the operational medium is placed in intimate thermal contact with a heat source at said second temperature; and a thermal regenerator section communicating between said cooler section and said heater section.

9. A Stirling cycle machine in accordance with claim 7 having only two reciprocating members, wherein the said conduit means are so arranged that:

each first subchamber defined in part by one of said reciprocating members is connected to at least one second subchamber having the same orientation; and each first subchamber defined in part by the other of said reciprocating members is connected to at least one second subchamber having an opposite orientation.

10. A Stirling cycle machine in accordance with claim 7 comprising at least three reciprocating members sequentially numbered with the first reciprocating member following the last reciprocating member, wherein each first subchamber is connected to at least one second subchamber defined in part by the next sequential reciprocating member, so as to form a closed chain of thermodynamic systems.

11. A Stirling cycle machine in accordance with claim 10 comprising an even number of reciprocating members wherein said conduit means are so arranged that in each of said thermodynamic systems all the interconnected subchambers have the same orientation.

12. A Stirling cycle machine in accordance with claim 10 wherein said conduit means are so arranged that in each of said thermodynamic systems a first subchamber has an orientation different from the orientation of all other subchambers in the said system.

13. A Stirling cycle machine in accordance with claim 7 in which each of said thermodynamic systems further comprises:

a third subchamber defined in part by said second reciprocating member;

means for maintaining said third subchamber at a third temperature; and conduit means interconnecting said third subchamber to each of said first and second subchambers.

14. A Stirling cycle machine in accordance with claim 13 wherein each of said conduit means further comprises:

a cooler section directly communicating with a first subchamber, whereby the operational medium is placed in intimate thermal contact with a cooling heat sink at said first temperature;

a heater section directly communicating with a second subchamber, whereby the operational medium is placed in intimate thermal contact with a heating heat source at said second temperature;

a refrigerator section directly communicating with a third subchamber, whereby the operational medium is placed in intimate thermal contact with a refrigerating heat source at said third temperature;

a first thermal regenerator section communicating between said cooler section and said heater section; and a second thermal regenerator section communicating between said cooler section and said refrigerator section.

15. A Stirling cycle machine in accordance with claim 7 wherein said thermodynamic systems comprises a first plurality of thermodynamic systems, each of which comprises:

a first subchamber defined in part by a first reciprocating member;

a second subchamber defined in part by a second reciprocating member;

first conduit means interconnecting said first and second subchambers;

and a second plurality of thermodynamic systems, each of which comprises:

a first subchamber defined in part by said first reciprocating member;

a third subchamber defined in part by said second reciprocating member;

means for maintaining said third subchamber at a third temperature; and second conduit means interconnecting said first and third subchambers.

16. A Stirling cycle machine in accordance with claim 15 wherein said first conduit means further comprises:

a cooler section directly communicating with a first subchamber, whereby the operational medium is placed in intimate thermal contact with a cooling heat sink at said first temperature;

a heater section directly communicating with a second subchamber, whereby the operational medium is placed in intimate thermal contact with a heat source at said second temperature;

a first thermal regenerator section communicating between said heater section and said cooler section;

and said second conduit means further comprises:

a cooler section directly communicating with a first subchamber, whereby the operational medium is placed in intimate thermal contact with a cooling heat sink at said first temperature;

a refrigerator section directly communicating with a third subchamber, whereby the operational medium is placed in intimate thermal contact with a refrigerating heat source at said third temperature; and a second thermal regenerator section communicating between said cooler section and said refrigerator section.

* * * * *